US008574016B1

(12) United States Patent
Cheng

(10) Patent No.: US 8,574,016 B1
(45) Date of Patent: Nov. 5, 2013

(54) KEY TYPE WIRING CONNECTION SWITCH

(75) Inventor: Liang-Chih Cheng, New Taipei (TW)

(73) Assignee: Liang-Chih Cheng, New Taipei (TW)

( * ) Notice: Subject to any disclaimer, the term of this patent is extended or adjusted under 35 U.S.C. 154(b) by 0 days.

(21) Appl. No.: 13/491,844

(22) Filed: Jun. 8, 2012

(51) Int. Cl.
*H01R 9/22* (2006.01)

(52) U.S. Cl.
USPC ..... 439/709

(58) Field of Classification Search
USPC ..... 439/709–722
See application file for complete search history.

(56) References Cited

U.S. PATENT DOCUMENTS 4,832,628 A * 5/1989 Huska ..... 439/716
5,030,139 A * 7/1991 Huska ..... 439/513
5,266,058 A * 11/1993 Sako et al. ..... 439/813
5,994,989 A * 11/1999 Rowe et al. ..... 335/202
6,916,213 B2 * 7/2005 Nyblin et al. ..... 439/709
7,134,922 B2 * 11/2006 Kim ..... 439/814
8,241,071 B1 * 8/2012 Hayama ..... 439/709

* cited by examiner

*Primary Examiner* — James Harvey
(74) *Attorney, Agent, or Firm* — David Ku

(57) ABSTRACT

A key type wiring connection switch includes an insulation main body, a plurality of spring elements, retaining terminals, conducting terminals and pressure buttons. In which a plurality of retaining spaces are formed in the interior of the insulation main body, The pressure buttons are positioned above each of the retaining terminals. Moreover, an upper end of each of the pressure buttons protrudes out the insulation main body. When using the present invention, the user presses downward on each of the pressure buttons to cause each of the lower ends of the pressure buttons to move downward and push open the retaining terminals, thereby enabling connecting wires of a host machine to be extended into the conducting terminals through side through holes of the insulation main body. Accordingly, when wiring an electrical appliance, there is no need for hand tools while still enabling wiring to be carried out.

4 Claims, 5 Drawing Sheets

KEY TYPE WIRING CONNECTION SWITCH

BACKGROUND OF THE INVENTION (a) Field of the Invention

The present invention relates to a key type wiring connection switch, and more particularly to eliminating the need for a hand tool (such as a screw driver) when wiring an electrical appliance, while enabling wiring to be carried out using only the hands.

(b) Description of the Prior Art

Referring to FIGS. 1, 2 and 3, depicting a traditional wiring connection switch, which, in general, comprises a wiring connector 10, with the wiring connector 10 fitted to an electrical appliance 1. The wiring connector 10 is used to provide a connector for connecting the electrical appliance 1 to connecting wires (not shown in the drawings) of the host machine.

The wiring connector 10 comprises an insulation main body 11, a plurality of electric conduction bases 12 and a plurality of screws 13. In which a plurality of retaining spaces 111 are formed in the interior of the insulation main body 11. Upper ends of the retaining spaces 111 are respectively provided with a through hole 112. Two sides of the insulation main body 11 are respectively provided with side through holes 113 which interconnect the retaining spaces 111. Each of the electric conduction bases 12 is fitted within the interior of each of the retaining spaces 111 of the insulation main body 11. The upper end of each of the electric conduction bases 12 is provided with a screw hole (not shown in the drawings), and each side is provided with an opening 121 which interconnects with the side through holes 113 of the insulation main body 11. Each of the screws 13 is respectively screwed into a screw hole in each of the electric conduction bases 12.

When using the wiring connection switch, the connecting wires 101 of the host machine are made to pass through the side through holes 113 of the insulation main body 11 and enter the openings 121 of the electric conduction base 12. A screw driver is used to screw down each of the screws 13 and fixedly lock the connecting wires 101 of the host machine to each of the electric conduction bases 12, thereby enabling electrical connection between the electrical appliance 1 and the host machine.

However, although the wiring connection switch of the prior art enables connecting the connecting wires of the host machine and thereby electrically connecting the electrical appliance 1 to the host machine, however, because use is made of the screws 13 to screw down and fixedly lock the connecting wires of the host machine. Thus, a screw driver is needed to fixedly lock each of the screws 13, causing difficulties in using the screw driver to screw down each of the screws 13 when installing the electrical appliance 1 in a cramped space (such as a ceiling). Accordingly, such a wiring connection switch is considerably inconvenient. Moreover, poor contact or the risk of electrical short circuit can easily result if the screws 13 are not screwed down tight enough.

SUMMARY OF THE INVENTION

In light of the aforementioned wiring connection switch of the prior art having the shortcoming of needing to use a screw driver to fixedly lock each screw, the inventor of the present invention, having accumulated know-how and manufacturing experience of a diverse range of electrical materials, attentively researched various methods to resolve the shortcomings, which, following continuous research and improvements, culminated in the design of a completely new key type wiring connection switch of the present invention.

A primary objective of the present invention is to provide a key-press wiring connection switch, which eliminates the need for hand tools when wiring an electrical appliance, while enabling wiring to be carried out using only the hands.

According to the aforementioned objective, the press-key wiring connection switch of the present invention comprises: an insulation main body, a plurality of spring elements, a plurality of retaining terminals, a plurality of conducting terminals and plurality of pressure buttons. In which a plurality of retaining space are formed in the interior of the insulation main body. The upper ends of the retaining spaces are respectively provided with a through hole. Two sides of the insulation main body are respectively provided with side through holes which interconnect the retaining spaces. Each of the spring elements is retained at the bottom portion of the interior of each of the retaining spaces. Each of the retaining terminals is retained in the interior of each of the retaining spaces, and the retaining terminals are respectively positioned above the spring elements, thereby enabling each of the retaining terminals to upwardly retain and secure a connecting wire of a host machine using the springiness of the spring elements. Each of the conducting terminals is retained in the interior of each of the retaining spaces, and the conducting terminals are respectively positioned above the retaining terminals corresponding to the positions of the side through holes of the insulation main body. The retaining terminals are used to upwardly retain and fixedly clamp connecting wires in the conducting terminals. A lower end of each of the pressure buttons is retained in the interior of each of the retaining spaces, and the lower ends are respectively positioned above the retaining terminals. Moreover, an upper end of each of the pressure buttons protrudes out the respective through hole of the insulation main body and is exposed to the exterior thereof. Accordingly, when each of the pressure buttons are pressed downward, the lower ends of each of the pressure buttons downwardly push open the retaining terminals, thereby causing the connecting wires of the host machine to separate from the grip of the retaining terminals. When using the present invention, the user is able to freely press down on each of the upper ends of the pressure buttons, to cause each of the lower ends of the pressure buttons to move downward and respectively push open the retaining terminals, thereby enabling the connecting wires of the host machine to be extended into the conducting terminals through the side through holes of the insulation main body. Releasing each of the pressure buttons causes each of the retaining terminals to upwardly spring back due to the springiness of the spring elements, and the retaining terminals upwardly retain and secure the positions of the connecting wires of the host machine in the conducting terminals, thus achieving an electrical connection between the electrical appliance and the host machine. Accordingly, the need for hand tools is eliminated and wiring of an electrical appliance can be carried out using only the hands.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
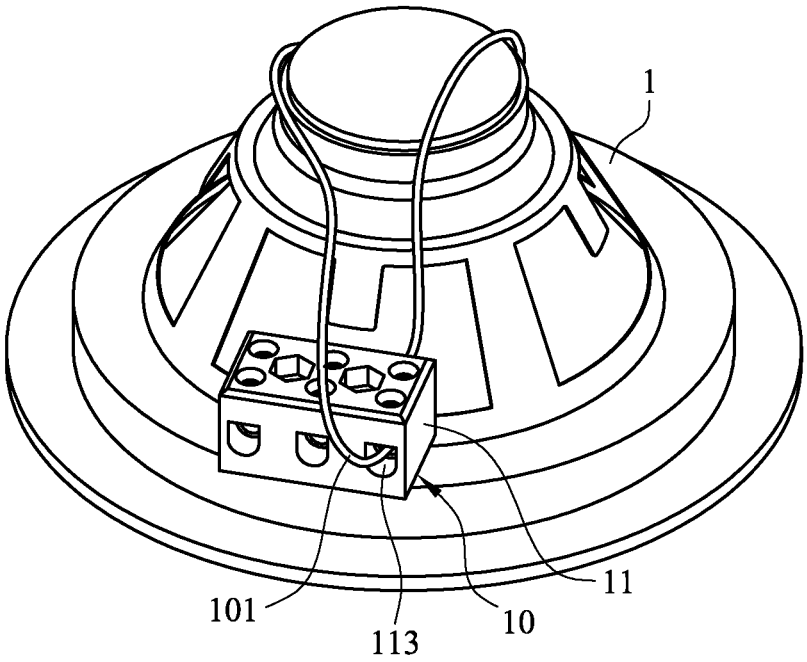
FIG. 1 Prior Art
FIG. 1 is an elevational view depicting an external appearance of a key type wiring connection switch of the prior art.
Figure 2:
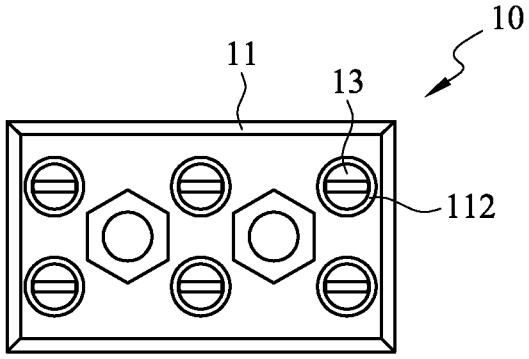
FIG. 2 Prior Art
FIG. 2 is a top view of the key type wiring connection switch of the prior art.
Figure 3:
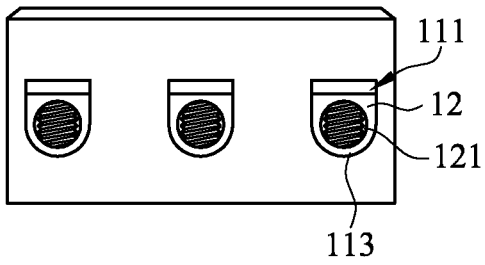
FIG. 3 Prior Art
FIG. 3 is a side view of the key type wiring connection switch of the prior art.
Figure 4:
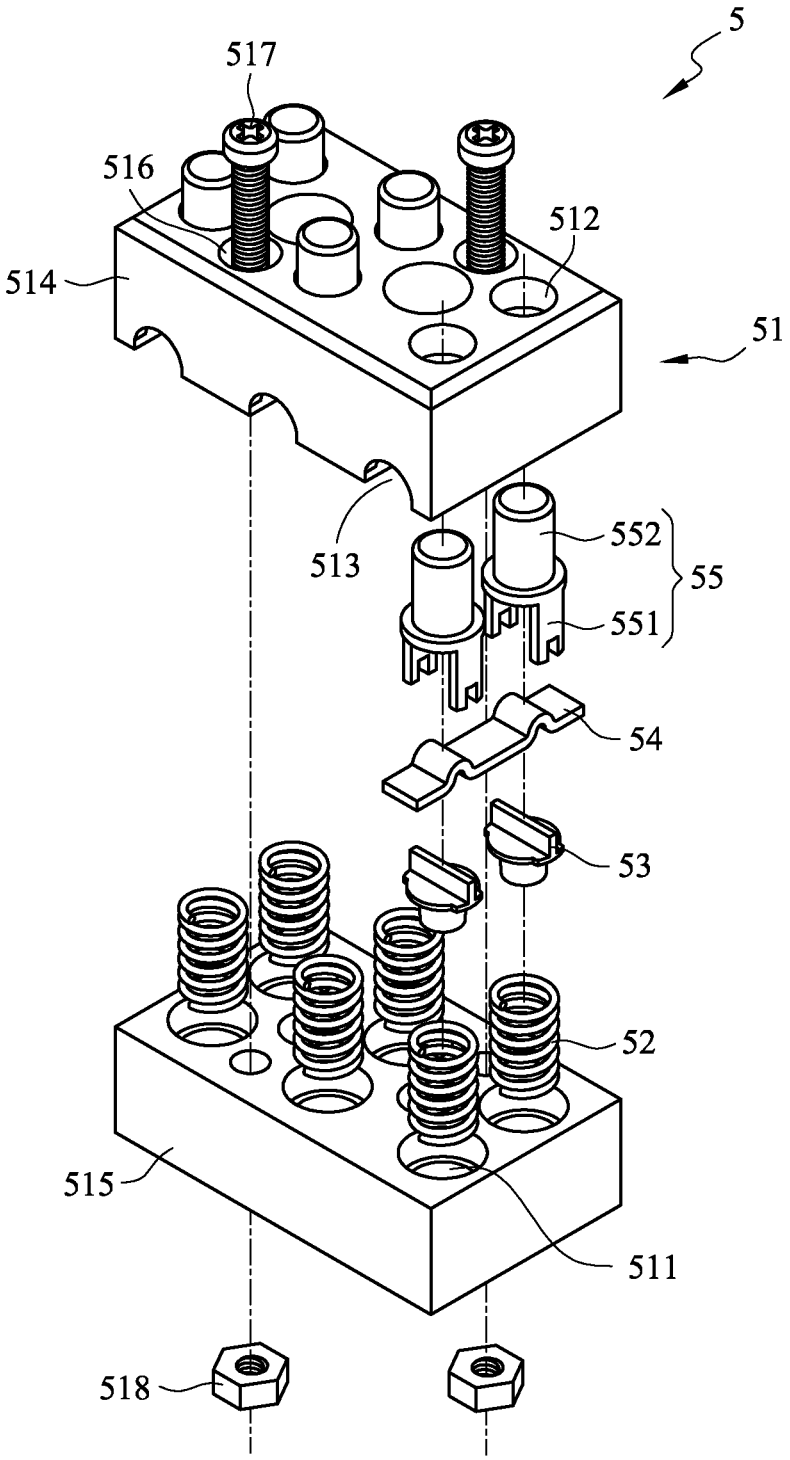
FIG. 4 is an exploded elevational view of a key type wiring connection switch of the present invention.
Figure 5:
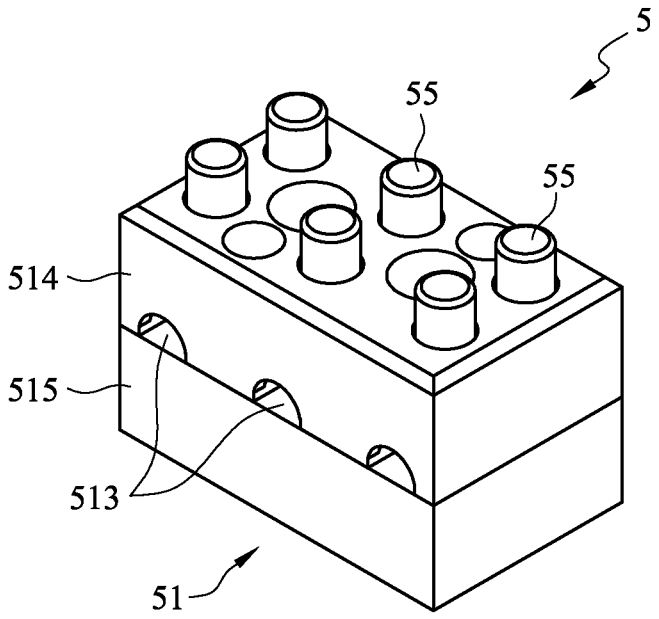
FIG. 5 is an elevational view depicting an external appearance of the key type wiring connection switch of the present invention.
Figure 6:
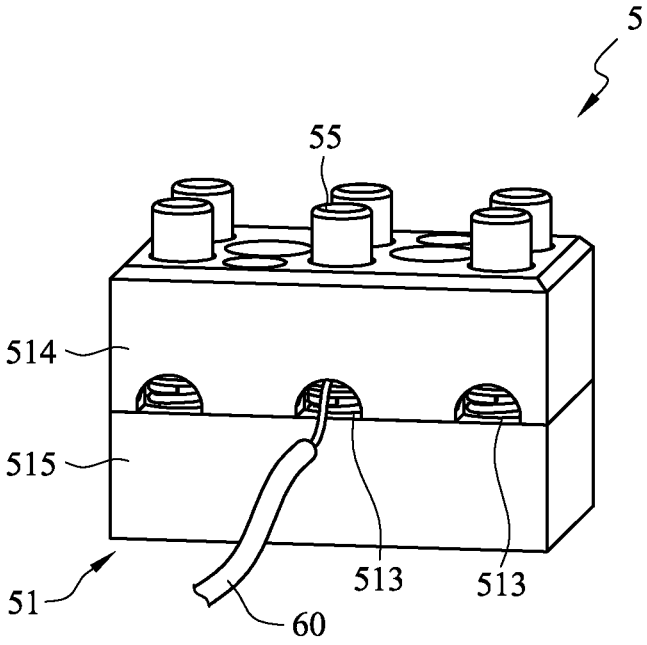
FIG. 6 is an elevational view of the key type wiring connection switch of the present invention in use.

The present invention relates to a key type wiring connection switch. Referring to FIGS. 4, 5 and 6. which show a key type wiring connection switch 5 of the present invention, which is fitted to an electrical appliance (not shown in the drawings). The key type wiring connection switch 5 primarily comprises: an insulation main body 51, a plurality of spring elements 52, a plurality of retaining terminals 53, a plurality of conducting terminals 54 and a plurality of pressure buttons 55.

A plurality of retaining spaces 511 are formed in the interior of the insulation main body 51. The upper ends of the retaining spaces 511 are respectively provided with a through hole 512. Two sides of the insulation main body 51 are respectively provided with side through holes 513 which interconnect the retaining spaces 511.

Each of the spring elements 52 is retained at the bottom portion of the interior of each of the retaining spaces 511.

Each of the retaining terminals 53 is retained in the interior of each of the retaining spaces 511, and the retaining terminals 53 are respectively positioned above the spring elements 52, thereby enabling each of the retaining terminals 53 to upwardly retain and secure a connecting wire 60 using the springiness of the spring elements 52.

Each of the conducting terminals 54 is retained in the interior of each of the retaining spaces 511, and the conducting terminals 54 are respectively positioned above the retaining terminals 53 corresponding to the positions of the side through holes 513 of the insulation main body 51. The retaining terminals 53 are used to upwardly retain and fixedly clamp the connecting wire 60 in the conducting terminal 54.

A lower end 551 of each of the pressure buttons 55 is retained in the interior of each of the retaining spaces 511, and the lower ends 551 are respectively positioned above the retaining terminals 53. Moreover, an upper end 552 of each of the pressure buttons 55 protrudes out the respective through hole 512 of the insulation main body 51 and is exposed to the exterior thereof. Accordingly, when the upper ends 552 of the pressure buttons 55 are pressed downward, the lower ends 551 of each of the pressure buttons 55 downwardly push open the retaining terminals 53, thereby causing the connecting wire 60 of the host machine to separate from the grip of the retaining terminals 53.

According to the assembly of the aforementioned components, when using the present invention, the user is able to freely press down on each of the upper ends 552 of the pressure buttons 55 to cause each of the lower ends 551 of the pressure buttons 55 to move downward and push open the retaining terminals 53, thereby enabling the connecting wire 60 of the host machine to be extended into the conducting terminals 54 through the side through holes 513 of the insulation main body 51. Releasing each of the pressure buttons 55 causes each of the retaining terminals 53 to upwardly spring back due to the springiness of the spring elements 52, and the retaining terminals 53 upwardly retain and secure the positions of the connecting wire 60 of the host machine in the conducting terminals 54, thereby achieving an electrical connection between the electrical appliance and the host machine.

Accordingly, when wiring an electrical appliance, there is no need for hand tools, and wiring can be carried out using only the hands.

Referring again to FIG. 4, the insulation main body 51 is structured by assembling an upper main body 514 and a lower main body 515. The upper main body 514 and the lower main body 515 are each provided with at least one through hole 516. A plurality of screws 517 and a plurality of screw nuts 518 respectively penetrate the through holes 516, and are used to fixedly lock together the upper main body 514 and the lower main body 515.

Referring yet again to FIG. 4, the insulation main body 51 can be made from plastic material.

Referring yet again to FIG. 4, the spring elements 52 can be springs.

The present invention provides a key type wiring connection switch, and is provided with the following advantages when compared to the aforementioned prior art:

1. When wiring an electrical appliance, there is no need for hand tools, and wiring can be carried out using only the hands.

2. Such a wiring method using only the hands enables avoiding being unable to tightly screw down the screws and the problems of poor contact or electrical short circuit resulting therefrom.

In conclusion, the press key wiring connection switch of the present invention is assuredly provided with a hitherto unknown innovative structure not found in the prior art. Moreover, no similar products have been seen in any publication or in the market. The present invention is thus provided with undoubted originality. In addition, the present invention is provided with unique characteristics and functionality that are without comparison in the prior art. Hence, the incomparable advancement of the present invention clearly complies with the essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A key type wiring connection switch, comprising: an insulation main body, a plurality of retaining spaces are formed in the interior of the insulation main body, the upper ends of the retaining spaces are respectively provided with a through hole, and two sides of the insulation main body are respectively provided with side through holes which interconnect the retaining spaces;

a plurality of spring elements, each of the spring elements is retained at the bottom portion of the interior of each of the retaining spaces;

a plurality of retaining terminals, each of the retaining terminals is retained in the interior of each of the retaining spaces, and the retaining terminals are respectively positioned above the spring elements, thereby enabling each of the retaining terminals to upwardly retain and secure a connecting wire using the springiness of the spring elements;

a plurality of conducting terminals, each of the conducting terminals is retained in the interior of each of the retaining spaces, and the conducting terminals are respectively positioned above the retaining terminals corresponding to the positions of the side through holes of the insulation main body, the retaining terminals are used to upwardly retain and fixedly clamp the connecting wire in the conducting terminal;

a plurality of pressure buttons, a lower end of each of the pressure buttons is retained in the interior of each of the retaining spaces, the lower ends are respectively positioned above the retaining terminals, and an upper end of each of the pressure buttons protrudes out the respective through hole of the insulation main body and is exposed to the exterior thereof; when the upper ends of the pressure buttons are pressed downward, the lower ends of each of the pressure buttons downwardly push open the retaining terminals, thereby causing the connecting wire of the host machine to separate from the grip of the retaining terminals.

2. The key type wiring connection switch according to claim 1, wherein the insulation main body is structured by assembling an upper main body and a lower main body; the upper main body and the lower main body are each provided with at least one through hole, and a plurality of screws and a plurality of screw nuts are used to respectively penetrate the through holes and fixedly lock together the upper main body and the lower main body.

3. The key type wiring connection switch according to claim 2, wherein the insulation main body is made from plastic material.

4. The key type wiring connection switch according to claim 1, wherein the spring elements are springs.

* * * * *